United States Patent [19]

Inselmann

[11] Patent Number: 4,560,431

[45] Date of Patent: Dec. 24, 1985

[54] DEVICE FOR GLUING SHEET-LIKE TEXTILE ARTICLES

[75] Inventor: Jürgen Inselmann, Löhne, Fed. Rep. of Germany

[73] Assignee: Herbert Kannegiesser GmbH & Co., Vlotho, Fed. Rep. of Germany

[21] Appl. No.: 572,477

[22] Filed: Jan. 20, 1984

[30] Foreign Application Priority Data

Feb. 2, 1983 [DE] Fed. Rep. of Germany ..... 3303504

[51] Int. Cl.[4] ..... B30B 5/06; B30B 15/34

[52] U.S. Cl. ..... 156/359; 100/93 P; 100/93 RP; 100/154; 156/555; 156/583.5; 219/446; 219/480; 219/486; 219/544

[58] Field of Search ..... 156/359, 555, 583.1, 156/583.4, 583.5; 100/93 P, 93 RP, 154; 219/255, 477, 480, 486, 510, 544, 548, 446

[56] References Cited

U.S. PATENT DOCUMENTS

| | | | |
|---|---|---|---|
| 2,435,641 | 2/1948 | Weber | 219/486 |
| 3,146,340 | 8/1964 | Dewey, II et al. | 219/548 |
| 3,166,110 | 1/1965 | Van Hartesveldt et al. | 100/93 P |
| 3,888,719 | 6/1975 | Gibbs et al. | 100/93 P |
| 4,272,673 | 6/1981 | Semanaz et al. | 219/544 |
| 4,398,991 | 8/1983 | Thies | 100/93 P |

*Primary Examiner*—Michael Wityshyn

*Attorney, Agent, or Firm*—Sughrue, Mion, Zinn Macpeak & Seas

[57] ABSTRACT

The device for gluing sheet-like textile articles contains a spreading station (15), a heating station (16), a pressing station (17) and a take-off station (18). The plate-shaped heating zones consist of several hollow-profile heaters (25) which are arranged next to one another and on the rear contact side (28) of which panel heaters are attached, each panel heater having at least one electrically heatable heating device (heating wire). The heating wires can be controlled each individually or in groups.

19 Claims, 9 Drawing Figures

DEVICE FOR GLUING SHEET-LIKE TEXTILE ARTICLES

DESCRIPTION

Figure 1:
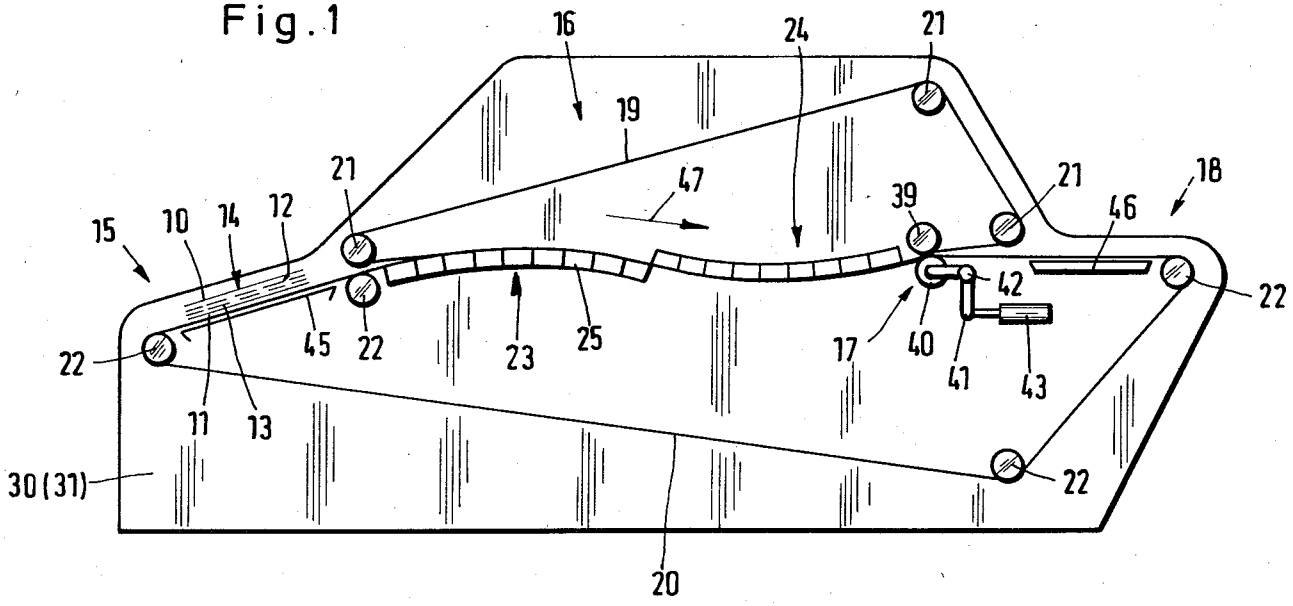

The invention relates to a device for gluing sheet-like textile articles, especially those for outer clothing (outer material and lining), with two conveyor belts which are driven continuously at the same speed, the textile articles to be joined together being conveyable between their sides resting against one another in the transport region, with a heating station having several heating zones, with a subsequent pressing station and, if appropriate, with a following cooling station, the individual heating zones being arranged in succession in the transport. plane of the conveyor belts and each having a heatable plate.

Such a device is known from German Offenlegungsschrift No. 2,248,181. This device has, in practice, working widths of 800 to 1,500 mm. The heated plates, arranged in succession in the working direction above and below the conveyor belts, allow effective heating sections of up to 2,000 mm. The subdivision of the heating sections into heating zones is governed, in the working direction, by the particular lengths of the heatable plates. In this device, the plates are heated on their rear side, that is to say on the side facing away from the transport plane, by infra red radiators. Furthermore, the plates are curved cylindrically transversely to the direction of transport, that is to say the cylinder axis lies transversely to the direction of transport, and are also arranged above and below the transport plane sinusoidally in succession in the direction of transport. As a result of the curved design and the sinusoidal arrangement, the conveyor belts rest with slight pressure against the working surfaces of the heated plates.

German Patent Specification No. 2,648,724 makes known a similar device in which two heating zones arranged in succession in the direction of transport each have two flat plates, which are located on both sides of the transport plane and in each of which are embedded several heating elements which can be controlled individually and switched on or off together in specific combinations. The individual heating zones can be subdivided into part regions over the working width of the plates, this subdivision being implemented by the additional provision of further heating elements.

German Offenlegungsschrift No. 2,145,447 shows a further device in which a plurality of electrically heated units in the form of rotatable rollers or hollow beams is arranged within the heating section in succession, transversely to the working direction of the device and alternately above and below the transport plane at a relatively great distance from one another. These units can be heated individually by means of heating bars, and in the case of hollow beams a U-shaped heating bar is located on the rear side or inside of the working surface of each beam profile. Moreover, the design and arrangement of the hollow beams are such that the conveying direction of the conveyor belts, with the textile articles located between them and to be glued to one another, experiences a change in the region of each beam. Consequently, the textile articles are not, as in the abovementioned devices (German Offenlegungsschrift No. 2,248,181 and German Patent Specification No. 2,648,724), conveyed along relatively long uninterrupted plate heating zones and at the same time heated. Also, in German Offenlegungsschrift No. 2,145,447, the individual heating devices can be controlled individually or in groups.

A disadvantage of the known devices with heatable plates or plate heating zones is that the various production sizes of the plates are relatively cost-intensive and therefore uneconomical to manufacture, and also that the design of the plates in heating terms cannot be considered the most efficient possible, because truly uniform heating of the working surfaces cannot be achieved, in practice, to the extent predetermined in each particular case. In the beam-shaped heating devices of German Offenlegungsschrift No. 2,145,447, it is also impossible to achieve heating which can be considered the most efficient possible, since heat radiation occurs in the relatively large gaps between the individual heating elements. Moreover, the textile articles undergo severe stress as their conveying direction changes, and this often even results in so-called corrugations in them.

Starting from German Offenlegungsschrift No. 2,248,181, the object of the invention is to improve the device of the type mentioned in the introduction, in such a way that the various different plate and heating zones or device production sizes required in practice can be produced economically with the most efficient design in heating terms. This object is achieved, according to the invention when each of the plates consist of several hollow-profile heaters arranged next to one another, when electrically heatable panel heaters are attached to the rear side of the working surface of the hollow-profile heaters, and when the panel heaters can be switched on and off individually or in groups.

Because the heated plates are designed according to the invention, the various production sizes of these can be produced considerably more cheaply and therefore more economically. Thus, for example as seen in the working direction of the device, plates of different lengths can be produced rapidly by joining together the particular requisite number of hollow-profile heaters, which can be made particularly cheaply in series, and can, if necessary, be quickly changed again to other lengths, this being of great advantage.

The provision of panel heaters ensures uniform heating, very largely free of energy losses, of the working surface of the hollow-profile heaters and consequently of the plate formed from several of these hollow-profile heaters, and this again also has an advantageous effect on the regulation and readjustment of the predetermined operating temperatures of this plate.

Because the individual heaters can be controlled in a way known per se, in particular individually or in groups, any desired temperature distribution or heating curve can be produced along the plates.

The herein disclosed represent a particularly economical solution, especially as regards the outlay in terms of assembly. However, the individual hollow-profile heaters must be slightly displaceable relative to one another in the transport direction, so that thermal stresses can be compensated.

In the arrangement according to the invention, the individual hollow-profile heaters can be mounted firmly on a frame, since each has sufficient space for thermal expansion.

According to an aspect of the invention the individual hollow-profile heaters are thermally insulated from one another, so that any temperature distributions in the direction of transport can be set without these heaters influencing one another. With only one or possibly with two different hollow-profile heaters, all plane, curved and cylindrical heating-zone working surfaces conventional in practice at the present time can be produced, thus ensuring a particular saving of costs.

Further simple assembly, at the same time with high stability, is achieved with simple prefabricated profiles.

Still further, the features of the invention disclosed herein ensure heating of the hollow-profile heaters or of the plates which is thermally very effective and which can be matched to various requirements, particularly different thermal engineering requirements.

Thus, it is possible to organize the heating of the heaters, particularly those with curved working surfaces, not only so that each of them is heated absolutely uniformly, but also so that each individual working surface or heater and/or groups of working surfaces or heaters are heated differently.

Furthermore, the design of the flexible panel heaters (heating mats) in the manner hereinafter described ensures good resistance to weathering and aging, and also temperature resistance up to continuous operating temperatures of approximately 200° C.

By means of other features of the invention hereinafter described, on the one hand the heating-up time can be reduced, and on the other hand effective control of the operating temperature can be carried out. For rapid heating-up, the heating elements are connected in parallel, with the result that a greater amount of electrical energy is used up and consequently more rapid heating-up takes place. To control relatively small deviations from the desired set operating temperature, it is then sufficient to provide a lower energy supply through the series connection.

Also described hereinafter is an appropriate thermostat and its associated switching elements.

Finally, a device for the individual heating and/or temperature control within the individual hollow-profile heaters or the individual plates is described.

Figure 2:
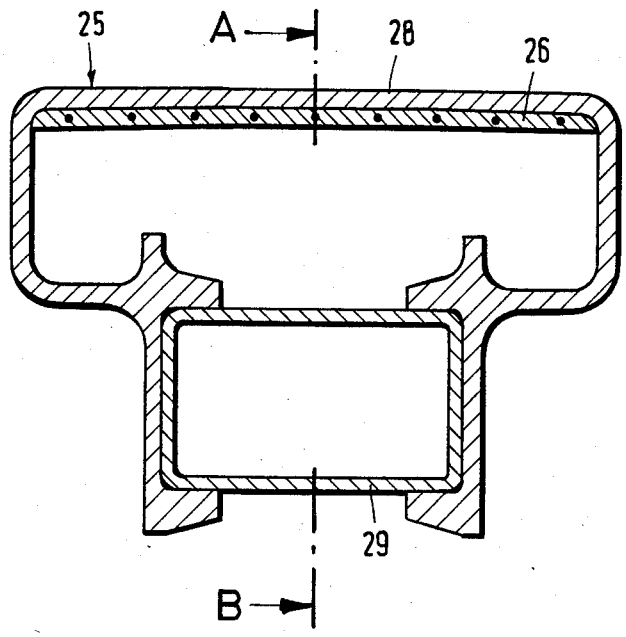
Figure 3:
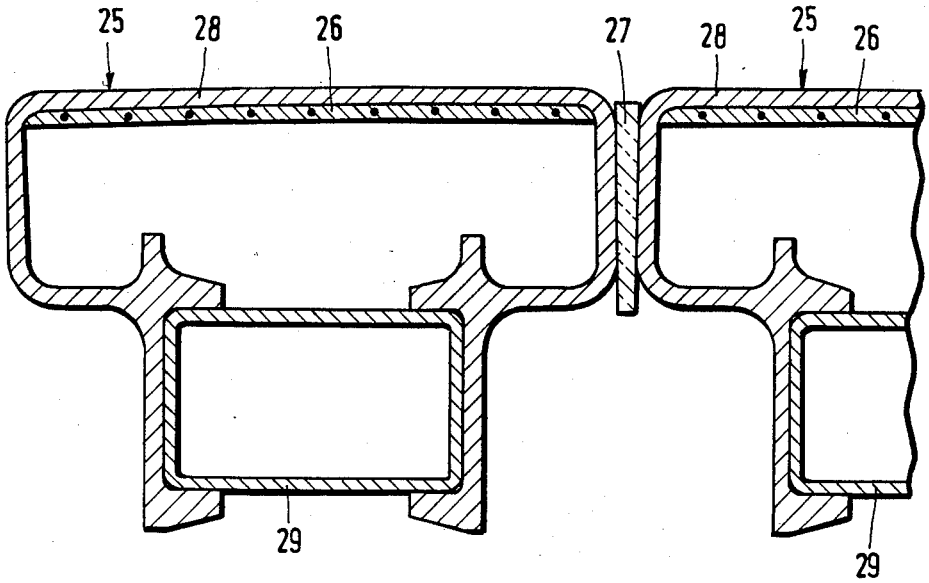
Figure 4:
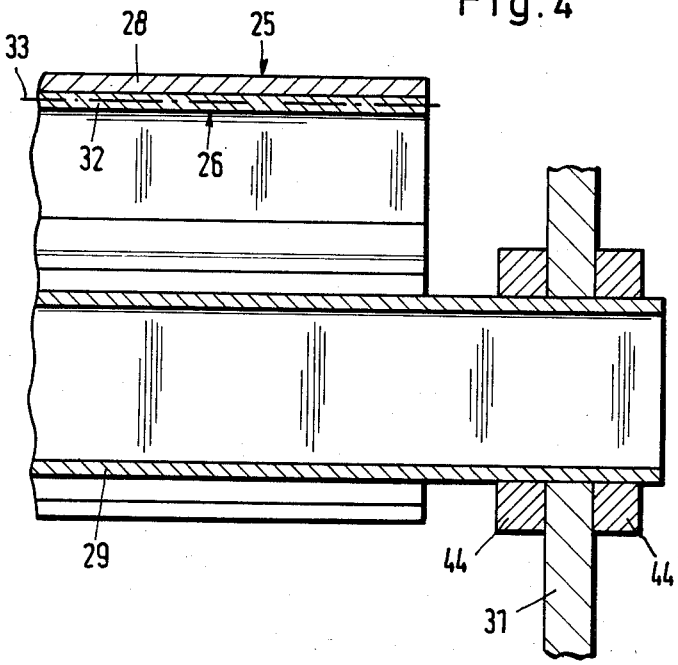
Figure 5:
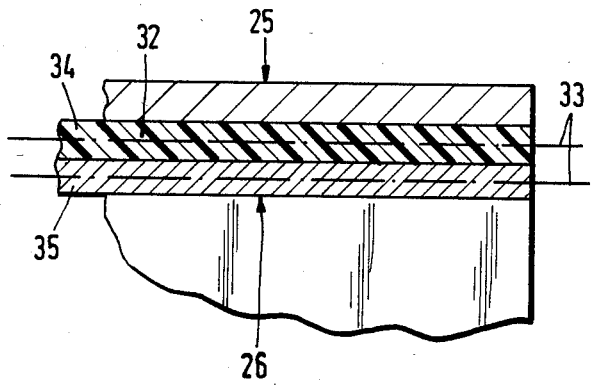
Figure 6:
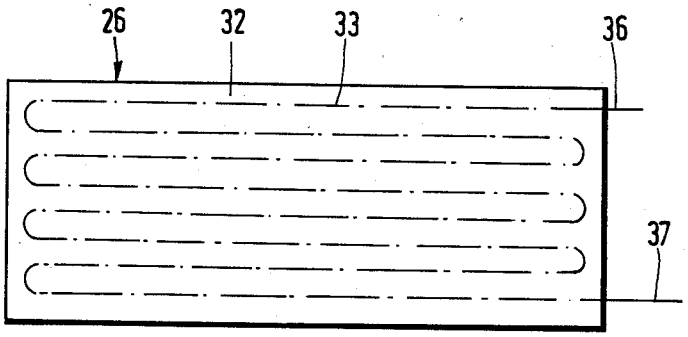
Figure 7:
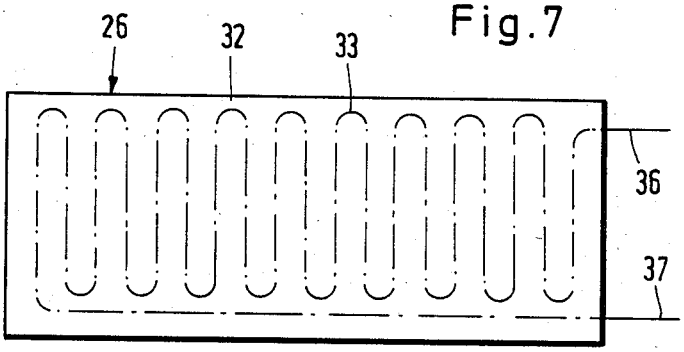
Figure 8:
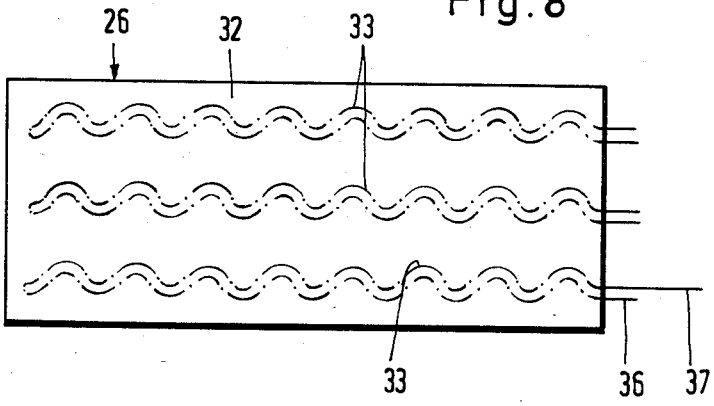
Figure 9:
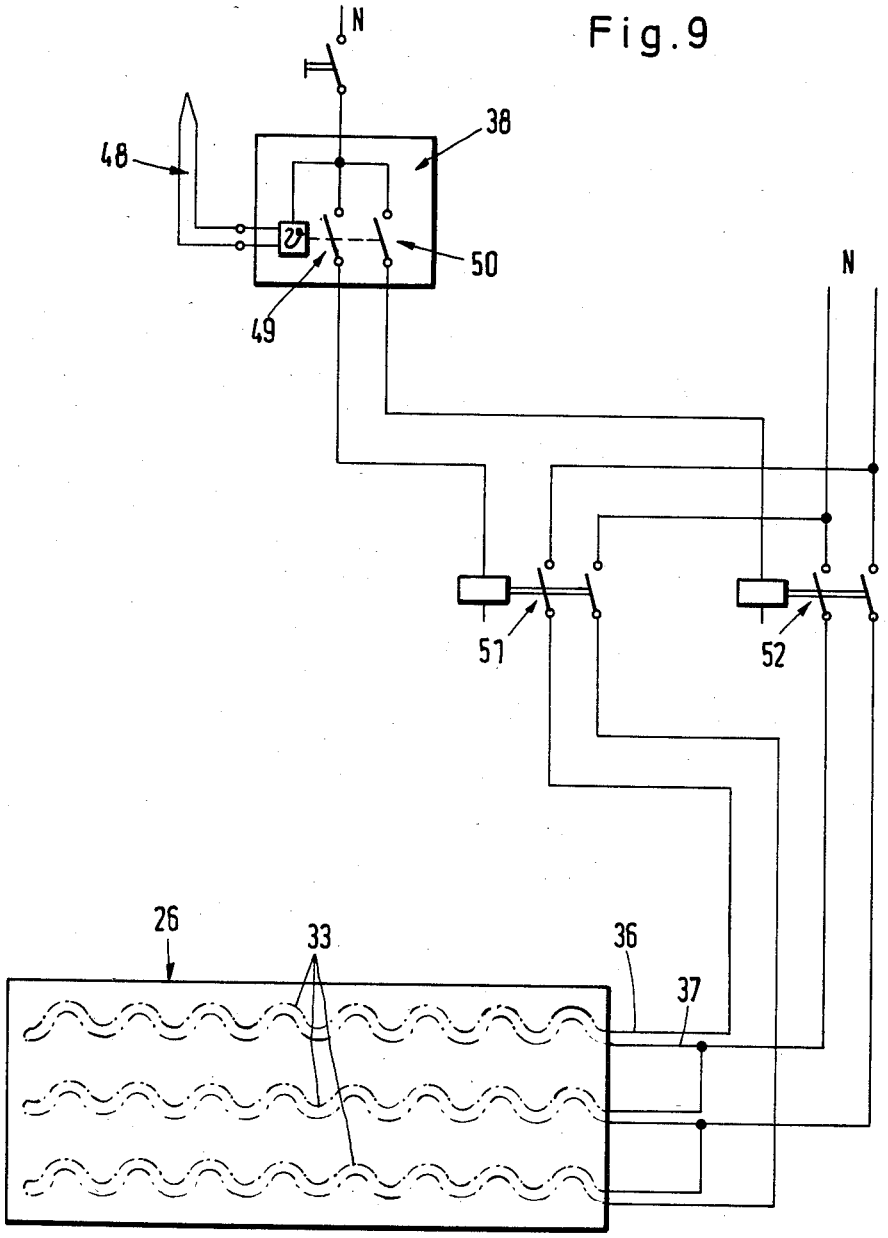

The invention is described in more detail below with reference to an exemplary embodiment in relation to the drawing in which:

FIG. 1 shows a diagrammatical longitudinal section (side view) of the device on a reduced scale, FIG. 2 shows a cross-section of an individual hollow-profile heater (in natural size) with an attached panel heater and supporting profile, FIG. 3 shows the relative position of two hollow-profile heaters according to an exemplary embodiment of the invention, FIG. 4 shows a partial longitudinal section along the sectional line A-B in FIG. 2, FIG. 5 shows a similar partial longitudinal section along the sectional line A-B in FIG. 2 on an enlarged scale and with a two-layer panel heater, FIGS. 6, 7 and 8 show plan views of a panel heater with different arrangement configurations of wire-type heating elements, FIG. 8 containing three heating elements, and FIG. 9 shows a wiring diagram of the control and regulating device for the panel heater of FIG. 8.

The reference symbols in the drawings denote:

10, 11=sheet-like textile articles (outer materials)
12, 13=sheet-like textile articles (linings)
14=gluing unit (from item 10 to item 13)
15=spreading station
16=heating station
17=pressing station
18=take-off station (cooling station)
19=conveyor belt (upper)
20=conveyor belt (lower)
21=roller (of item 19)
22=roller (of item 20)
23, 24=plates (curved)
25=hollow-profile heater
26=panel heater (heating mat)
27=insulating layer (between items 25/25)
28=wall (working surface of item 25)
29=supporting profile (for item 25)
30, 31=side walls (of the device frame)
32=plastic material
33=heating element (heating wire)
34, 35=layers (layers of item 26)
36, 37=current feed terminal (of item 33)
38=thermostat
39, 40=pressure rollers (of item 17)
41=roller-supporting lever
42=fulcrum (of item 41)
43=pressure cylinder
44=setting ring (for the lateral mounting of item 29 on items 30, 31)
45=table plate (in item 15)
46=table plate, cooled (in item 18)
47=arrow (the conveying direction of items 19/20)
48=temperature sensor (of item 38)
49=switch contact "operating temperature" (of item 38)
50=switch contact "heating change-over" (of item 38)
51, 52=contactors (for switching item 33)

By means of the device according to the invention, sheet-like textile articles are to be glued to one another. Two outer materials 10 and 11 can be seen in FIG. 1, two linings 12 and 13 being arranged between them, and from top to bottom the outer material 10, the linings 12 and 13 and the outer material 11 form a gluing unit 14 which rests on a spreading station 15. The gluing unit is transported from the spreading station 15 through a heating station 16 where it is heated under slight pressure. From there, it passes into a pressing station 17 and subsequently to a take-off station 18 which can, if appropriate, be designed as a cooling station. For transport purposes, there are two conveyor belts 19 and 20 which run parallel to one another within the heating station 16 and the pressing station 17 and which transport the gluing unit 14 between them. The upper conveyor belt 19 is guided via rollers 21 and a pressure roller 39 of the pressing station 17. The lower conveyor belt 20 is guided via rollers 22 and a pressure roller 40 of the pressing station 17. The lower conveyor belt 20 is longer than the upper conveyor belt 19 and also runs via the spreading station 15 and the take-off station 18. The heating station 16 has several heating zones which are formed by curved plates 23 and 24. In FIG. 1, the first plate 23 is located underneath the transport plane and therefore underneath the lower conveyor belt 20. However, the curvature of the plate 23 is such that the two conveyor belts 19 and 20 are pressed out of the plane formed between the rollers at the entrance and exit of the heating station. The plate 23 is followed by a plate 24 which is located above the two conveyor belts and which is curved in the opposite direction to the plate 23, so that the two conveyor belts 19 and 20 are pressed downwards out of the said plane in their region of influence. In the exemplary embodiment illustrated, the two plates 23 and 24 are curved in such a way that the transport path through the heating station has approximately a sinusoidal shape. As a result, the two conveyor belts are pressed against one another within the heating station and thus exert a certain pressing force on the gluing unit 14.

The plates 23 and 24 consist of individual elements, that is to say hollow-profile heates 25, which are arranged next to one another so that as a whole they form a "plate-shape" structure. More detailed features are explained further below.

From the heating station 16, the two conveyor belts pass between the pressure rollers 39, 40 of the pressing station 17. In the exemplary embodiment illustrated, the upper roller 39 is arranged fixed in place, whilst the lower pressure roller 40 serves as a pressing-on roller. For this purpose, it is mounted on a roller-supporting lever 41 which is pivotable about a fulcrum 42. That end of the roller-supporting lever 41 which is facing away from the pressure roller 40 is articulated on a pressure cylinder 43, via which the desired pressing force of the pressing station can be adjusted. The rollers 21, 22 for the two conveyor belts 19, 20 are arranged behind the pressing station 17, in such a way that the two conveyor belts 19, 20 move apart from one another. The lower conveyor belt 20 then runs via the take-off station 18 which has a cooled table plate 46.

The conveyor belts 19 and 20 are driven and guided continuously in the direction of the arrow 47 by means of the rollers 21 and 22 respectively. For tensioning the conveyor belts 19 and 20, there are tensioning devices known per se, which have been omitted in the drawing for the sake of a clear illustration. The two conveyor belts 19 and 20 can be perforated. The spreading station 15 also contains a table plate 45.

The mode of operation of the device according to FIG. 1 is as follows: the gluing unit 14, which is placed on the lower conveyor belt 20 in the spreading station 15 by the operator of the device and which consists of the sheet-like textile articles 10, 11 (outer materials) and 12, 13 (linings) laid on one another in the manner of a sandwich, is guided by this belt, interacting with the upper conveyor belt 19, under slight pressing force over the curved heated plates 23, 24 and is at the same time heated. The gluing unit 14 is heated in such a way that first the lower side of it is heated in a continuous heating process by means of contact heat, the upper side being preheated at the same time by the evaporating inherent moisture in the lower side. Immediately after this, the upper side of the gluing unit 14 is heated further by the plate 24 by means of contact heat, and at the same time as this the already fully heated lower side is maintained at the correct temperature, particularly as a result of inherent moisture which continues to evaporate, whilst at the same time the evaporated inherent moisture no longer required for heating is discharged through the lower perforated conveyor belt 20. This guarantees, among other things, that only uniformly heated sheet-like textile articles are supplied to the pair of pressure rollers 39, 40 which are under a relatively high pressing force, as a consequence of which only sheet-like textile articles glued together perfectly arrive at the take-off station 18.

All the above-described parts of the device are retained or accommodated in a device frame which is indicated by the side walls 30 and 31 in FIG. 1.

The special feature of the invention is the design of the heating station 16. Here, the plates 23 and 24 are composed of individual hollow-profile heaters 25 which are described in more detail in relation to FIGS. 2 to 5. The hollow-profile heaters 25 preferably consist of extruded aluminum hollow-profile bars, the profile of which can be seen in FIG. 2. Briefly, this profile is mirror-symmetrical to a center line (sectional line A-B) and has on its upper side a wall 28, the outside of which forms the working surface. Adjoining this laterally, approximately at right angles, are two shorter legs which are parallel to one another and which each merge, in turn, into a short leg pointing towards the center line and extending parallel to the wall 28. From there, a further leg lying parallel to the center line then extends again in each case. The two last-mentioned legs have short noses which are directed towards the center line and which serve for receiving a substantially rectangular supporting profile 29 which is preferably designed as an extruded steel hollow-profile bar. Thus, this supporting profile 29 rests against the last-mentioned legs and against the noses of which there are four altogether. In the transitional region between the short legs pointing towards the center line and the adjoining legs touching the supporting profile 29, there is also a short web which points in the direction of the wall 28 and which serves for increasing the rigidity of the hollow-profile heater 25.

A panel heater 26 in the form of a flexible heating mat is applied, specifically preferably vulcanized or glued, to the rear side of the working surface, that is to say that surface of the wall 28 which is directed inwards. This flexible heating mat consists of a plastic material 32 (preferably silicone elastomers) which is preferably reinforced with glass-fiber fabric and in which heating wires are embedded. FIGS. 2 and 3 show these heating wires as dots.

The wall 28 is slightly curved to correspond to the shape of the curvature of the plates 23, 24, and is also rounded off in the outer regions.

According to a preferred exemplary embodiment of the invention, as shown in FIG. 3, adjacent hollow-profile heaters 25 are arranged next to one another, with an insulating layer 27 being included. The insulating layer 27 is preferably made elastic and slightly wedge-shaped. The elasticity of the insulating layer 27 can absorb thermal expansions of the individual hollow-profile heaters 25.

It is evident that by an appropriate arrangement of any number of the hollow-profile heaters 25 described above it is possible to compose any plate sizes from "standard modules". Also, as seen in the direction of transport, any configurations can be produced as regards the curvature.

It can be seen from FIG. 4 how the individual hollow-profile heaters 25 can be fastened via the supporting profile 29 to the device frame, that is to say the side walls 31. The supporting profiles 29 project laterally beyond the hollow-profile heaters 25 and pass through an orifice in the side wall 31, where they are fixed on both sides of the side wall by setting rings 44. If the orifices in the side walls 31 are designed as slots, it is also guaranteed that the individual hollow-profile heaters 25 can be displaced relative to one another in the direction of transport, as a result of which thermal expansions can be absorbed, especially when the insulating layer 27 has been omitted.

FIG. 5 shows a multi-layer panel heater 26 which is composed of layers 34, 35 resting on one another in the manner of a "sandwich", and one or more wire-shaped heating elements 33 are embedded in a plastic material 32 in each layer 34, 35. Because of the arrangement of the heating wires 33, any temperature distributions which may be desired can be obtained.

Examples of the arrangement of the heating wires 33 in the panel heaters 26 are shown in FIGS. 6 through 8. In FIG. 6, a heating wire is embedded in the plastic material 32 in the form of a meander, that is to say forming U-shaped loops, in such a way that the long legs of the U are parallel to the long side of the panel heater 26 and consequently transverse to the direction of transport of the device. The current feed terminals 36 and 37 are guided out on the same side of the panel heater 26, specifically on its short side.

In FIG. 7, a meander-shaped arrangement of the heating wires 33 is chosen again, but in this case the long legs of the U extend parallel to the short sides of the panel heater 26, and it is also ensured here that the two current feed terminals 36, 37 project on the same side of the panel heater.

In FIG. 8, three separate heating wires 33 are embedded in the plastic material 32, and here they are each arranged in the form of a loop curved in a serpentine configuration, these loops running parallel to the long side and parallel to each other. Here again, the current feed terminals 36 and 37 project on one short side of the panel heater 26.

In this arrangement of the heating wires 33, the circuit illustrated in FIG. 9 can be produced in an especially advantageous way. It must be pointed out, however, that several panel heaters having a configuration of the heating wires according to FIGS. 6 and 7, whether in a multi-layer arrangement according to FIG. 5 or whether they each belong to different hollow-profile heaters 25, can be wired up in the same way. Advantageously, it is possible in particular, here, to change over from a parallel connection of the individual heating wires to a series connection. Electrical energy is supplied from the mains N via contactors 51 and/or 52. In the position illustrated, both contactors 51, 52 are open, so that the heating wires 33 are isolated from the mains. When the contactor 51 is closed, but the contactor 52 is open, the three heating wires 33 are connected in series. The current then flows from the left-hand contact of the contactor 51 to the uppermost heating wires 33, from this into the middle heating wire, from this into the lower heating wire, and finally from this back via the right-hand contact of the contactor 51.

If, on the other hand, both contactors 51, 52 are closed, the common junction points between the output of the upper heating wire and the input of the middle heating wire and between the output of the middle wire and the input of the lower heating wire are connected to the mains via the contactor 52, so that the three heating wires 33 are connected electrically in parallel.

In a third switching combination in which the contactor 51 is open and the contactor 52 is closed, only the middle heating wire 33 is supplied with energy.

The contactors 51 and/or 52 are controlled via a thermostat 38. For this purpose, a temperature sensor 48 can be arranged in the panel heater 26 in the region of the wall 28 of the hollow-profile heater 25 or else in the region of the transport plane of the conveyor belts 19, 20. An evaluation circuit $\theta$ connected to the mains via a further switch actuates two switch contacts 49 and 50 which are thereby connected to the mains or isolated from them and which then actuate the contactors 51 and 52 respectively.

When the mains voltage is applied to the thermostat 38, the evaluation circuit $\theta$ detects whether the temperature measured by the temperature sensor 48 is well below a set nominal temperature. When this is so, the device is in the "heating-up phase". The two switch contacts 49 and 50 are then closed, as a result of which the contactors 51, 52 are closed and the heating wires 33 are connected to the mains in parallel. Rapid heating-up takes place as a result. If the evaluation circuit $\theta$ detects that the temperature measured by the temperature sensor 48 is below the desired operating temperature by only a predetermined amount (for example 30° C.), the switch contact 50 is opened, whilst the switch contact 49 still remains closed. Because the switch contact 50 is opened, the contactor 52 is opened, whilst the contactor 51 still remains closed. As a result, as described above, the three heating wires 33 are connected in series. Consequently, the energy supply is markedly reduced, so that the remaining heating-up to the operating temperature takes place correspondingly more slowly. This also prevents relatively large "overshoots", such as those which otherwise occur in a normal 2-point control. When the predetermined temperature is reached at the measuring point of the temperature sensor 48, the switch contact 49 is also opened via the evaluation circuit $\theta$, whereupon the contactor 51 opens again and the heating wires 33 are disconnected. The fine adjustment of the operating temperature is then carried out by actuating the switch contact 49. The above-described method of regulating the operating temperature and that of automatically adjusting it subsequently by means of the thermostat 38 permit a tolerance of at most $\pm 3\%$, preferably a tolerance of 1%.

The control described can be provided once only for all the hollow-profile heaters 25 or panel heaters 26 of a plate 23 or 24, according to the particular requirements, or else it can also be provided for each heating element 33. It is also possible to assign it to combinations of plates, heaters and/or heating elements.

All the technical details shown in the claims, the description and the drawings can be essential to the invention either in themselves or in any combination.

I claim:

1. A device for gluing sheet-like textile articles comprising, two conveyor belts which are driven continuously and at the same speed, said conveyor belts overlaying each other in a transport region, with textile articles to be joined together being conveyable between the overlaying belts in the transport region, a heating station having several heating zones, and a pressing station located downstream of the heating zones in the conveying direction, the pressing station and individual heating zones being arranged in succession in the transport plane of the conveyor belts, each heating zone having a heatable plate (23, 24), wherein each of the heatable plates (23, 24) consists of several hollow-profile heaters (25) arranged next to one another, and wherein each hollow-profile heater includes an electrically heatable panel heater (26) attached to the rear side of a top wall (28) of its respective hollow-profile heater said device for gluing further including means for selectively supplying electricity to said panel heaters (26) either individually or in groups.

2. A device as claimed in claim 1, wherein the hollow-profile heaters (25) of the individual plates (23, 24)

are arranged such that adjoining hollow-profile heaters (25) contact one another.

3. A device as claimed in claim 1, wherein the hollow-profile heaters (25) of the individual plates (23, 24) are arranged such that adjacent hollow-profile heaters are spaced from one another at a distance allowing expansion.

4. A device as claimed in claim 1 or 3, wherein adjacent hollow-profile heaters (25) include between them an insulating layer (27).

5. A device as claimed in claim 1, wherein the top wall (28) of the individual hollow-profile heaters (25) is curved, to define the curvature of the individual plates (23, 24).

6. A device as claimed in claim 1, further including, supporting profiles (29) for carrying a plurality of the hollow-profile heaters (25), said supporting profiles being mountable to side walls (31) of the device.

7. A device as claimed in claim 6, wherein the hollow-profile heaters (25) are constructed of extruded aluminum hollow-profile bars, and the supporting profiles (29) are constructed of extruded steel hollow-profile bars.

8. A device as claimed in claim 1, wherein the panel heaters (26) are flexible heating mats fixedly attached to the rear side of the top wall (28) of a respective hollow-profile heater (25).

9. A device as claimed in claim 8, wherein the panel heaters (26) consist of a fabric-reinforced plastic material (32) with embedded heating elements (33).

10. A device as claimed in claim 9, wherein the flexible panel heaters (26) are made multilayered, each layer (34, 35) having one or more heating elements (33) embedded therein, the individual layers (34, 35) being fixedly attached to one another.

11. A device as claimed in claim 9, wherein a silicone-rubber vulcanized material (silicone elastomers) serves as the plastic material (32).

12. A device as claimed in claim 9, wherein the fabric reinforcement is a glass-fiber fabric.

13. A device as claimed in claim 9, wherein the heating elements (33) are heating wires.

14. A device as claimed in claim 13, wherein the heating wires (33) are embedded in the plastic material (32) in the form of a U their current feed terminals (36, 37) being located on a side of the panel heaters (26) which extends parallel to the direction of transport.

15. A device as claimed in claim 14, wherein two or more layers of heating wires (33) in arrangements having different configurations are embedded above one another in the plastic material (32).

16. A device as claimed in one of claims 9, 13 to 15, wherein the heating elements (33) of each panel heater (26) can be connected either in parallel or in series.

17. A device as claimed in claim 16, further comprising at least one thermostat (38) which first connects the heating elements (33) in parallel (heating-up phase) and then (shortly before the operating temperature is reached) changes them over to a series connection, until the predetermined operating temperature on a working surface of the top wall (28) of the hollow-profile heaters (25) is reached, with a tolerance of at most +3%.

18. A device as claimed in claim 17, wherein an additional switching contact (50) is provided in the thermostat (38) for the change-over from a parallel connection to a series connection.

19. A device as claimed in claim 17, wherein two or more heating elements (33) of a panel heater (26) and two or more hollow-profile heaters (25) can be regulated as regards their temperature in a predetermined group combination.

* * * * *